US009346059B2

(12) United States Patent
Jensen et al.

(10) Patent No.: US 9,346,059 B2
(45) Date of Patent: May 24, 2016

(54) SHREDDER WITH VIBRATION PERFORMANCE SENSOR AND CONTROL SYSTEM

(71) Applicant: Fellowes, Inc., Itasca, IL (US)

(72) Inventors: Michael Dale Jensen, Round Lake, IL (US); Dennis William Gruber, Arlington Heights, IL (US); Daniel Namie, Elburn, IL (US); Dipan Surati, Des Plaines, IL (US)

(73) Assignee: FELLOWES, INC., Itasca, IL (US)

( * ) Notice: Subject to any disclaimer, the term of this patent is extended or adjusted under 35 U.S.C. 154(b) by 68 days.

(21) Appl. No.: 14/560,503

(22) Filed: Dec. 4, 2014

(65) Prior Publication Data

US 2015/0083836 A1 Mar. 26, 2015

Related U.S. Application Data

(63) Continuation of application No. 13/384,986, filed as application No. PCT/US2010/042223 on Jul. 16, 2010, now Pat. No. 8,931,721.

(60) Provisional application No. 61/226,902, filed on Jul. 20, 2009.

(51) Int. Cl.
*B02C 18/22* (2006.01)
*B02C 25/00* (2006.01)
(Continued)

(52) U.S. Cl.
CPC ..... *B02C 25/00* (2013.01); *B02C 18/0007* (2013.01); *B02C 18/142* (2013.01); *B02C 18/2266* (2013.01); *B02C 2018/164* (2013.01); *B02C 2018/166* (2013.01)

(58) Field of Classification Search
CPC .. B02C 25/00; B02C 18/0007; B02C 18/142; B02C 18/22; B02C 18/2266; B02C 18/164
USPC ..... 241/100, 236, 36
See application file for complete search history.

(56) References Cited

U.S. PATENT DOCUMENTS 4,866,358 A 9/1989 Stuyvenberg
5,004,166 A 4/1991 Sellar
(Continued)

FOREIGN PATENT DOCUMENTS

GB 2209963 A 6/1989
JP 2007136264 A 6/2007

OTHER PUBLICATIONS

International Search Report and Written Opinion mailed on Dec. 20, 2010 in International Application No. PCT/US2010/042223.
(Continued)

*Primary Examiner* — Faye Francis
(74) *Attorney, Agent, or Firm* — Pillsbury Winthrop Shaw Pittman LLP

(57) ABSTRACT

A shredder includes a shredding mechanism and a vibration sensor configured to detect vibrations generated by the shredding mechanism. The shredder includes a controller configured to regulate operation of the shredder's motor in response to the detected vibrations. The controller may regulate operation of the shredder so as to keep the detected vibrations below a predetermined vibration level during operation of the shredder. The controller may modify operation of the shredder (e.g., turn the shredder off, conduct an autocorrect sequence, increase or decrease the shredder's speed, display an error message) in response to the detected vibrations having a predetermined characteristic (e.g., frequency and/or amplitude within a predetermined range, a characteristic that indicates a material/paper jam or misfeed). The controller may change the predetermined characteristics over the life of the shredder to account for gradual changes to the shredder's baseline vibration characteristics as components wear in and out.

20 Claims, 11 Drawing Sheets

(51) Int. Cl.

| | |
|---|---|
| ***B02C 18/00*** | (2006.01) |
| ***B02C 18/14*** | (2006.01) |
| *B02C 18/16* | (2006.01) |

(56) References Cited

U.S. PATENT DOCUMENTS

| | | | | |
|---|---|---|---|---|
| 5,386,945 | A | 2/1995 | Nose et al. | |
| 5,662,280 | A * | 9/1997 | Nishio | B02C 18/0007 241/30 |
| 5,772,129 | A * | 6/1998 | Nishio | B02C 18/0007 241/30 |
| 6,260,780 | B1 | 7/2001 | Kroger et al. | |
| 6,561,444 | B1 | 5/2003 | Yokomine et al. | |
| 7,040,559 | B2 | 5/2006 | Matlin et al. | |
| 7,325,759 | B2 | 2/2008 | Meyer | |
| 8,931,721 | B2 * | 1/2015 | Jensen | B02C 18/0007 241/100 |
| 2006/0266855 | A1 | 11/2006 | Meyer | |
| 2009/0014565 | A1 | 1/2009 | Matlin et al. | |
| 2012/0111979 | A1 * | 5/2012 | Jensen | B02C 18/0007 241/25 |

OTHER PUBLICATIONS

International Preliminary Report on Patentability mailed on Jul. 26, 2011 in International Application No. PCT/US2010/042223.

* cited by examiner

SHREDDER WITH VIBRATION PERFORMANCE SENSOR AND CONTROL SYSTEM

CROSS REFERENCE

This application is a continuation of U.S. patent application Ser. No. 13/384,986, filed Jan. 19, 2012, titled "SHREDDER WITH VIBRATION PERFORMANCE SENSOR AND CONTROL SYSTEM," and claims the benefit of priority from that application, from its parent PCT Application No. PCT/US2010/042223, filed Jul. 16, 2010, titled "SHREDDER WITH VIBRATION PERFORMANCE SENSOR AND CONTROL SYSTEM," and from U.S. Provisional Application No. 61/226,902, filed Jul. 20, 2009, titled "SHREDDER WITH VIBRATION PERFORMANCE SENSOR AND CONTROL SYSTEM," the entire contents of each of which are hereby incorporated by reference herein.

FIELD OF THE INVENTION

The present invention relates to the field of shredders, and specifically relates to control systems that regulate the operation of shredders.

BACKGROUND OF THE INVENTION

Shredders are well known devices for destroying materials, such as documents, CDs, floppy disks, etc. Typically, users purchase shredders to destroy sensitive materials, such as credit card statements with account information, documents containing company trade secrets, etc.

A common type of shredder has a shredding mechanism contained within a housing that is removably mounted atop a container. The shredding mechanism typically has a series of cutter elements that shred materials fed therein and discharge the shredded materials downwardly into the container. A common shredding mechanism utilizes two motor-driven cutting cylinders with interleaving cutter elements to shred materials.

Various shredders include motor feedback loops to help regulate operation of the shredder (e.g., to detect temperature and reduce motor load to avoid overheating; to detect resistance and/or current across the motor and regulate its operation accordingly). For example, conventional shredders have sensed motor current, speed, and/or temperature to control shredder operation. It is also known to use an externally sensing microphone in a shredder to turn off the shredder in response to the microphone detecting a person's voice (e.g., a loud voice saying "stop"). Dahle's Model No. 31214 is an example of such a voice-deactivated shredder.

Various embodiments and/or aspects of the present invention endeavor to provide various improvements over known shredders.

SUMMARY OF THE INVENTION

One or more embodiments of the present invention provides a shredder that includes a shredding mechanism including an electrically powered motor and cutter elements. The shredding mechanism enables materials to be shredded to be fed into the cutter elements. The motor is operable to drive the cutter elements so that the cutter elements shred the materials fed therein. The shredder also includes a control system that includes a sensor configured to detect vibrations generated by operation of the shredder, and a controller coupled to the sensor. The controller is configured to regulate operation of the motor in response to the detected vibrations having a predetermined characteristic.

According to one or more of these embodiments, the control system is configured to isolate vibrations of a predetermined type from a remainder of the detected vibrations, and the controller is configured to regulate the operation of the motor in response to the isolated vibrations having the predetermined characteristic. The predetermined type may comprise a predetermined frequency range and/or a predetermined amplitude range (e.g., levels above a threshold, below a threshold, or within a band).

According to one or more of these embodiments, the control system is configured to isolate detected vibrations generated by the shredding mechanism from detected vibrations generated by material being shredded by the shredding mechanism, and the controller is configured to regulate the operation of the motor in response to the isolated, detected vibrations having the predetermined characteristic.

According to one or more of these embodiments, the sensor is mounted to the shredding mechanism so as to detect vibrations propagating from the shredding mechanism to the sensor via the mount between the sensor and shredding mechanism.

According to one or more of these embodiments, the controller is configured to run the motor in reverse in response to the detected vibrations having the predetermined characteristic.

According to one or more of these embodiments, the shredder also includes an autofeed mechanism, and the controller is configured to run the autofeed mechanism in reverse in response to the detected vibrations having the predetermined characteristic.

According to one or more of these embodiments, the predetermined characteristic is indicative of a malfunction, and the controller is configured take an action in an attempt to correct the malfunction in response to the detected vibrations having the predetermined characteristic.

According to one or more of these embodiments, the control system is configured to convert the detected vibrations generated by the shredder into a vibration signal. The control system may also include a filter configured to filter the vibration signal, and an amplifier configured to amplify the vibration signal.

According to one or more of these embodiments, in response to the detected vibrations exceeding a predetermined vibration level, the control system is configured to regulate operation of the motor so as to reduce vibrations generated by operation of the shredder while continuing to operate the motor.

According to one or more of these embodiments, the shredder also includes a display. The controller may be configured to display a message on the display in response to the detected vibrations having a second predetermined characteristic. The second predetermined characteristic may be associated with a shredder event. The message may pertain to the event.

According to one or more of these embodiments, the predetermined characteristic includes a frequency within a predetermined frequency range, and/or an amplitude within a predetermined amplitude range.

According to one or more of these embodiments, the predetermined characteristic includes a characteristic that indicates a material jam in the shredder or indicates that material is not being fed into the shredding mechanism.

According to one or more of these embodiments, the controller is configured to change the predetermined characteristic in response to change criteria. The change criteria may include a predetermined amount of operation of the shredder.

According to one or more of these embodiments, the controller is configured to detect, via the sensor, a change in the shredder's baseline vibrational characteristics, and modify the predetermined characteristic in response to detecting a change in the shredder's baseline vibrational characteristics.

According to one or more of these embodiments, the shredder includes a memory, wherein the control system is configured to convert the detected vibrations into vibration signals and record the vibration signals to the memory.

According to one or more of these embodiments, the controller is configured to detect motor run-on based, at least in part, on the detected vibrations.

According to one or more of these embodiments, the predetermined characteristic comprises a characteristic that is indicative of motor run-on. The controller is configured to stop the motor from running following a predetermined delay after detecting the characteristic that is indicative of motor run-on.

According to one or more of these embodiments, the controller is configured to detect an amount of load being placed on the shredder from the detected vibrations.

According to one or more of these embodiments, the controller is configured to estimate a thickness of material being shredded by the shredding mechanism based, at least in part, on the detected vibrations.

According to one or more of these embodiments, the controller is configured to detect a material misfeed based, at least in part, on the detected vibrations.

According to one or more of these embodiments, the shredder includes a body into which material shredded by the shredding mechanism enters. The controller may be configured to determine an amount of shredded material contained within the body based, at least in part, on the detected vibrations.

One or more embodiments of the invention provide a method for controlling a shredder that includes a shredding mechanism including an electrically powered motor and cutter elements, a vibration sensor, and a controller. The shredding mechanism enables materials to be shredded to be fed into the cutter elements. The motor is operable to drive the cutter elements so that the cutter elements shred the materials fed therein. The method includes detecting, via the sensor, vibrations generated by operation of the shredder during operation of the shredder. The method also includes detecting, via the controller, that the detected vibrations indicate a particular shredder event. The method also includes regulating, via the controller, operation of the motor in response to the detected shredder event.

According to one or more of these embodiments, the detected shredder event may include any one or more of: a material jam in the shredder, material not being fed into the shredding mechanism, motor run-on, and/or an amount of noise being generated by the shredder.

According to one or more of these embodiments, said detecting, via the controller, that the detected vibrations indicate the particular shredder event comprises detecting that the detected vibrations have a predetermined characteristic. The method may also include modifying the predetermined characteristic in response to change criteria. According to one or more of these embodiments, the method also includes detecting, via the sensor, a change in the shredder's baseline vibrational characteristics. The method may also include modifying the predetermined characteristic in response to detecting the change in the shredder's baseline vibrational characteristics.

According to one or more of these embodiments, the method also includes displaying a message on a display of the shredder in response to the detected vibrations having a predetermined characteristic. The message may pertain to a shredder event associated with the predetermined characteristic.

According to one or more of these embodiments, the particular shredder event includes the detected vibrations exceeding a predetermined vibration level. The regulating may include reducing vibrations generated during operation of the shredder while continuing to operate the motor.

One or more embodiments of the invention provide a shredder that includes a shredding mechanism including an electrically powered motor and cutter elements. The shredding mechanism enables materials to be shredded to be fed into the cutter elements. The motor is operable to drive the cutter elements so that the cutter elements shred the materials fed therein. The shredder also includes a control system that includes a sensor configured to detect vibrations generated during operation of the shredder, and a controller coupled to the sensor. In response to the detected vibrations exceeding a predetermined vibration level, the control system is configured to regulate operation of the motor so as to reduce vibrations generated during operation of the shredder while continuing to operate the motor.

According to one or more of these embodiments, the shredder also includes a user input that enables a user to change the predetermined vibration level.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

The novel features that are considered characteristic of the invention are set forth with particularity in the appended claims. Various embodiments of the invention, however, both as to its structure and operation together with the additional objects and advantages thereof are best understood through the following description of the preferred embodiments of the present invention when read in conjunction with the accompanying drawings, wherein:

DETAILED DESCRIPTION

Figure 1A:
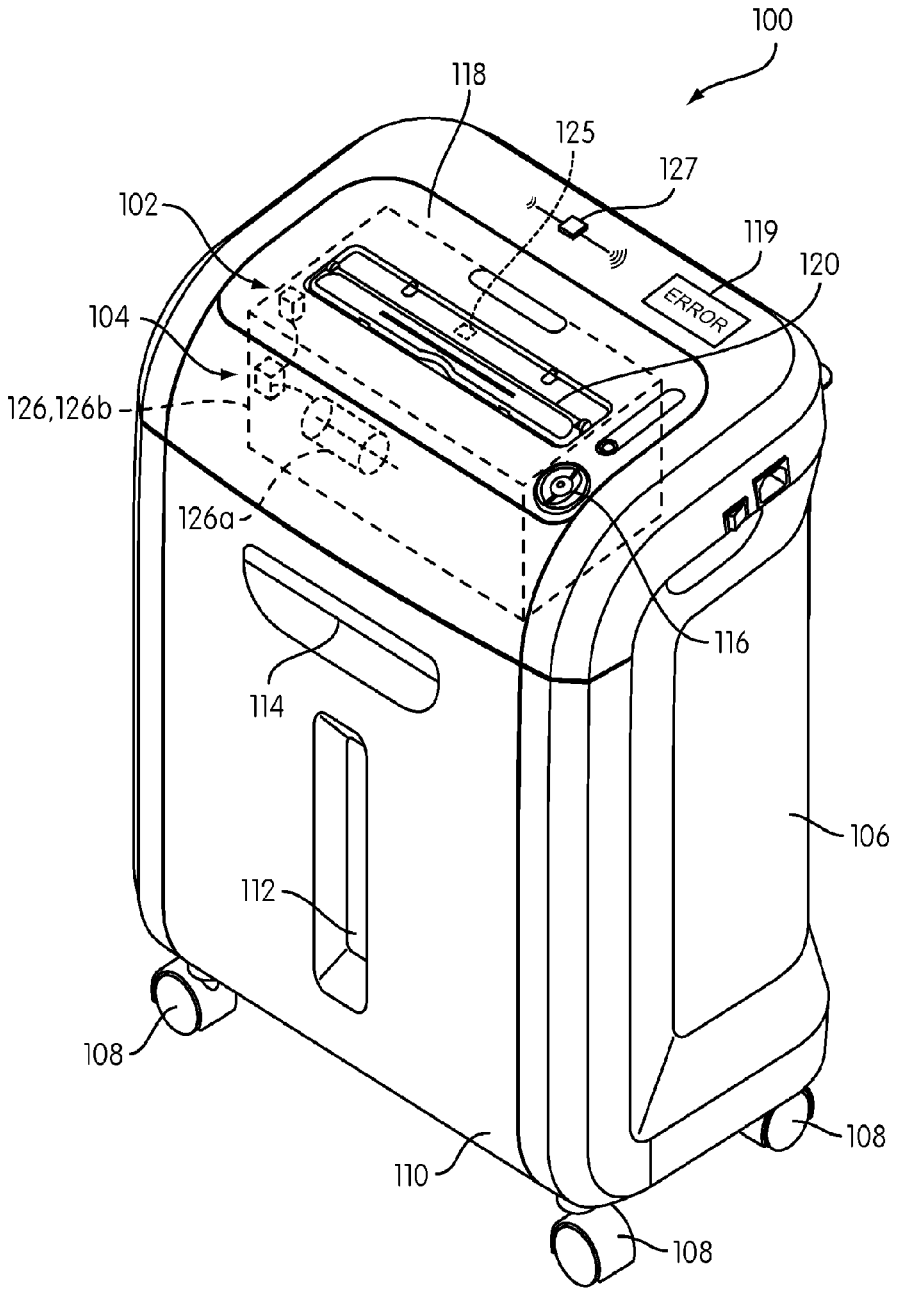
FIG. 1A illustrates a shredder having a sensor and control system according to one embodiment of the present invention.
Figure 1B:
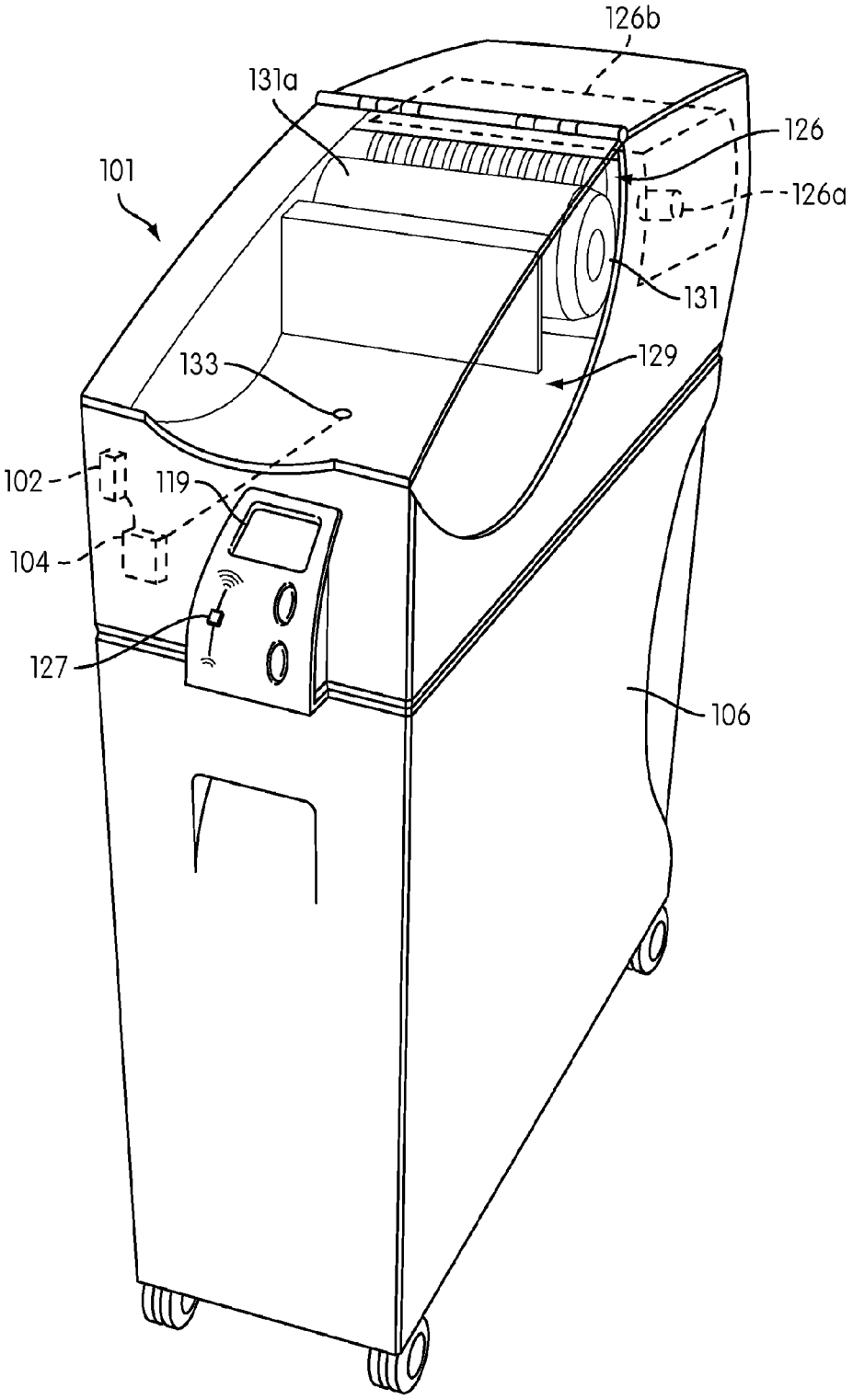
FIG. 1B illustrates an auto feed shredder having a sensor and control system according to another embodiment of the present invention.

As illustrated in FIGS. 1A and 1B, a control system including a sensor 102 and a controller 104 according to one or more embodiments of the present invention may be incorporated into various types of shredders (e.g., the manual feed shredder 100 illustrated in FIG. 1A and the auto feed shredder 101 illustrated in FIG. 1B).

As shown in FIG. 1A, the manual feed shredder 100 has a sensor 102 and controller 104 according to an embodiment of the present invention. The shredder 100 includes a container/body 106 mounted on casters 108 for storing shredded materials 124. The body 106 includes a front panel 110 that is provided with a window 112. Window 112 allows for the visual inspection of the contents of body 106 to determine what volume of body 106 has been filled with shredded material. A handle 114 is provided to allow for access to the interior of body 106 to remove shredded material. An ON/OFF switch 116 is provided on the side of shredder 100. A top panel 118 is formed in the top of shredder 100 in which throat 120 is located. Materials to be shredded are manually fed through the throat 120. Within body 106, just below opening 120, is a shredding mechanism 126, which shreds materials into strips (in the case of a strip cut shredder) and/or bits (in the case of a cross cut shredder). According to one or more embodiments, the shredding mechanism 126 includes a motor 126*a*, a shredding block/frame 126*b*, and cutting cylinders/blades/elements that are used to shred paper, for example as is shown in U.S. Pat. Nos. 6,260,780 and 7,040,559, which are hereby incorporated herein by reference.

The shredder 100 may include an autorun function that relies on a material detector 125 positioned to detect the presence of material to be shredded in the throat 120. The detector 125 may be any type of suitable detector (e.g., a beam interrupt detector that senses when material is fed into the throat and breaks a beam that crosses the throat 120, a physical switch that is activated when material is fed into the throat 120). The detector 125 operatively connects to the controller 104. When the shredder 100 is turned on (i.e., an autorun state), the controller 104 turns the motor 126*a* on in response to the detector 125 detecting the presence of material to be shredded in the throat 120. When the detector subsequently detects that material is no longer being fed into the throat 120, the controller 104 waits a predetermined time (e.g., 0, 2, 5,or more seconds), commonly referred to as run-on time, and then turns the motor 126*a* off.

The shredder 100 is merely provided for exemplary purposes and is in no way meant to be limiting as to the scope of the present invention.

As shown in FIG. 1B, the auto feed shredder 101 has a sensor 102 and controller 104. The shredder 101 typically shreds one or a few sheets at a time from an input bin 129 via an auto feed mechanism 131, which includes a conventional rolling drum and vacuum mechanism according to one or more embodiments. After putting a stack of paper to be shredded into the input bin 129, the user typically leaves the shredder 101 during operation. During such unattended operation of the shredder 101, the sensor 102 senses whether paper in the input bin 129 is actually being fed into the shredding mechanism 126 of the shredder 101 and shredded. The shredder 101 then takes corrective action if the sensor 102 and controller 104 determines that a fault has occurred (e.g., paper is not being fed into the shredder 101 and shredded).

According to various embodiments of the present invention, the sensor 102 and controller 104 may be incorporated into any type of suitable auto feed shredder, for example, the shredder disclosed in U.S. Patent Application Publication No. 2009-0014565 A1, the contents of which are hereby incorporated by reference herein.

Sensor 102 and controller 104 are provided to determine the state of shredder 100, 101 and control the operation of shredder 100, 101 based upon this sensed state. Sensor 102 is a vibration sensor that is preferably located at a position on shredder 100, 101 such that it can detect vibrations emanating from the shredding mechanism 126. The sensor 102 is preferably located within the interior of shredder 100, 101, and is preferably disposed at a location that reduces its exposure to noise produced from a source outside of shredder 100, 101. For example, the sensor 102 may be positioned within an enclosed interior portion of the shredder 100, 101, and therefore partially shielded from waves propagating from a source of sound outside of shredder 100, 101. The sensor 102 may be mounted to a portion of the shredder 100,100 in such a manner that the sensor 102 senses vibrations emanating from the shredding mechanism 126 (or some other vibration generating part of the shredder 100, 101 such as the autofeed mechanism 131) via transmission of the vibrations from the shredding mechanism 126 to the sensor 102 via the physical connection/mounting between the sensor 102 and shredding mechanism 126. For example, the sensor 102 may mount to the shredding block/frame 126*b* of the shredding mechanism 126 so as to detect vibrations that propagate from the shredding mechanism (e.g., motor 126*a* or actual cutting cylinders of the mechanism 126) to the sensor 102 via the shredding block/frame 126*b*. Such mounting to the shredding mechanism 126 may, but need not be a direct mount to the shredding mechanism 126. Rather, intermediate structure(s) may be present such that detected vibrations propagate through such intermediate structure(s). Alternatively and/or additionally, the sensor 102 may be positioned to detect vibrations that propagate through the air from the vibrating structure to the sensor 102.

Vibration sensors 102 are well known and exist in many varieties. The most common type of sensor used for vibration monitoring applications are accelerometers. Accelerometers are useful for measuring low to very high frequencies and are available in a wide variety of general purpose and application specific designs. Accelerometers made from solid state piezoelectric materials are highly desirable due to their cost, versatility, and reliability. The piezoelectric element in the sensor produces a signal proportional to acceleration. This small acceleration signal can be amplified for acceleration measurements or converted (electronically integrated) within the sensor into a velocity or displacement signal. The piezoelectric velocity sensor is more rugged than a coil and magnet sensor such as a microphone, has a wider frequency range, and can perform accurate phase measurements. Other types of vibration sensors 102 may be used, such as, for example, an audio microphone or laser vibration sensor. Diagrams of systems and circuits that condition and amplify vibration signals sensed by sensor 102 are disclosed in FIGS. 2-4. Conditioning and amplifying these vibration signals allows controller 104 to control the operation of shredder 100, 101.

Figure 2:
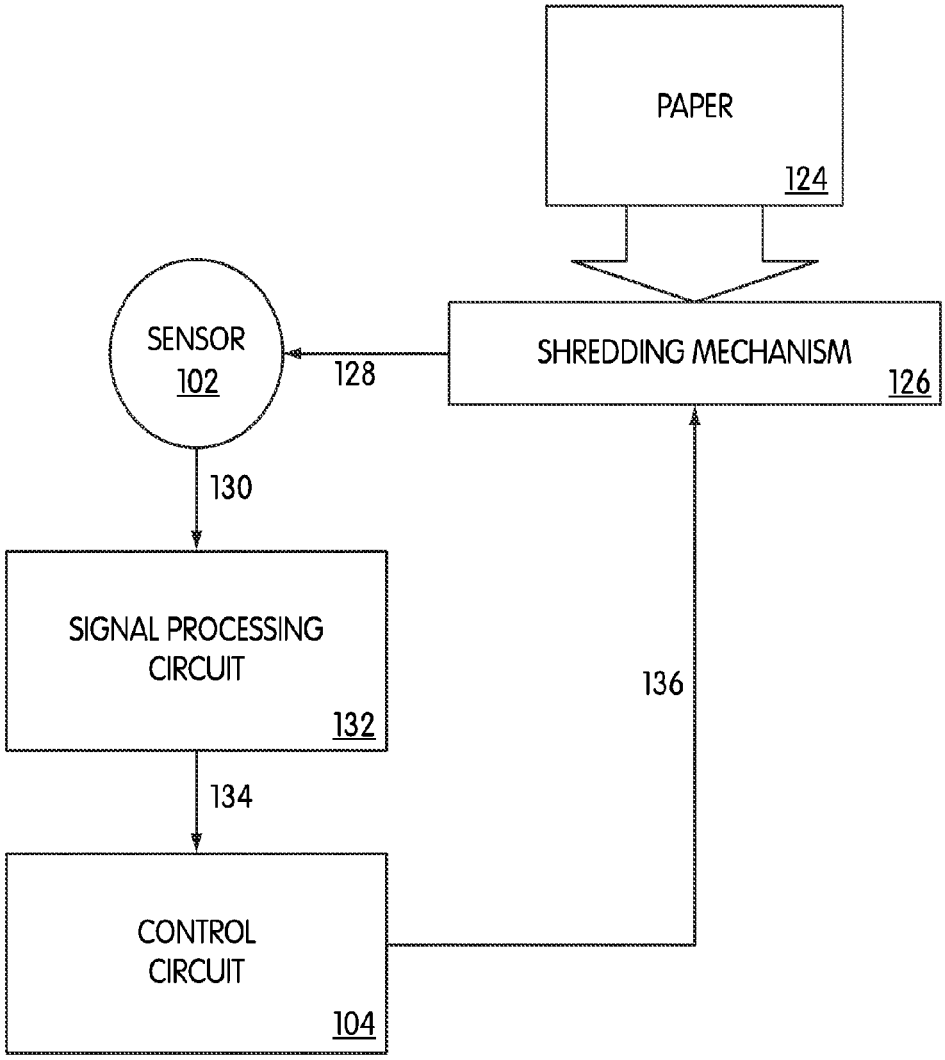
FIG. 2 illustrates a block diagram of a vibration performance sensor and control system according to an embodiment of the present invention.

FIG. 2 illustrates a block diagram of a shredder system having a vibration performance sensor 102 and controller 104 according to an embodiment of the present invention. Paper 124 is fed into the shredding mechanism 126 of shredder 100, 101. The shredding mechanism 126 shreds the paper 124. Vibrations 128 emanating from shredding mechanism 126 are detected by sensor 102 mounted to or within the shredder 100, 101. An unconditioned and un-amplified signal 130 is transmitted to signal processing circuit 132, which conditions and amplifies the signal 130 from sensor 102 and transmits it as conditioned signal 134 to controller 104. Controller 104 then utilizes the conditioned and amplified signal to transmit a control signal 136 back to control shredding mechanism 126.

Figure 3A:
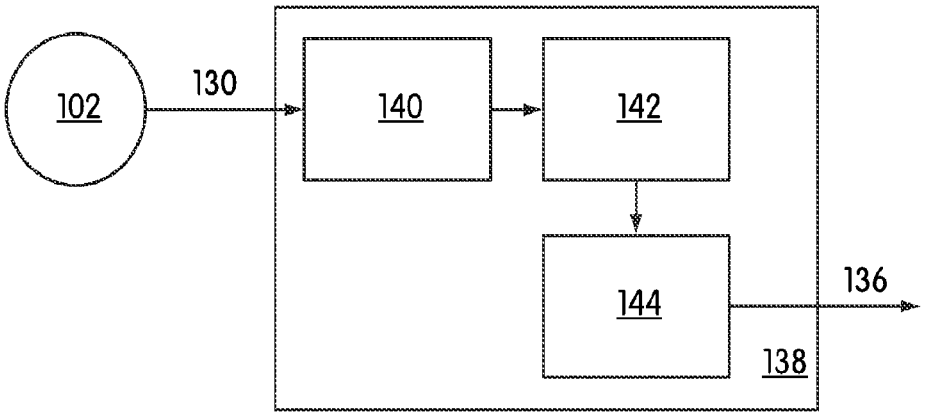
FIGS. 3A-3C illustrate three different processor configurations for processing vibration signals detected with a vibration performance sensor according to various embodiments of the present invention.
Figure 3B:
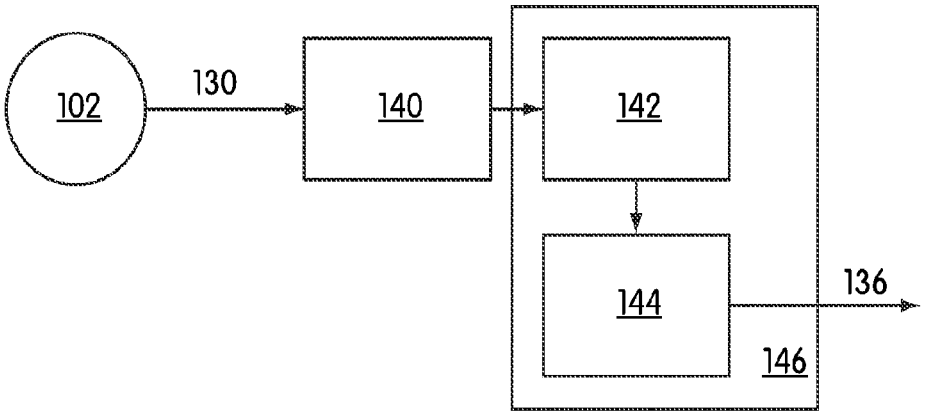
Figure 3C:
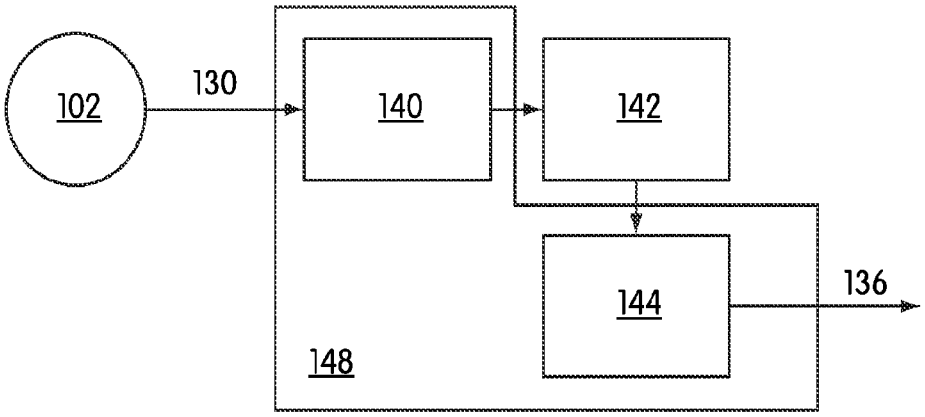

FIGS. 3A-3C illustrate three different processor configurations 138, 146 and 148 for processing vibration signals 128 detected with a vibration performance sensor 102 according to various embodiments of the present invention. In FIG. 3A, processor 138 includes a filtering circuit block 140, an amplification circuit block 142, and a processing circuit block 144. The filtering circuit block 140 conditions the signal 130 to remove noise. The amplification circuit block 142 amplifies the signal 130 for processing by processing the circuit block 144. The processing circuit block 144 analyzes the signal 130 and determines what control signal output 136 to issue based upon the signal 130.

As used herein, the term "circuit block" and similar phrases is used not to denote a physical structure per se, but rather to denote or demarcate the circuit and/or logic elements in hardware or software that perform the associated function. Thus, the term "block" is used in the sense it is conventionally used in schematic or flowchart diagrams/layouts of hardware/software elements.

In FIG. 3A, the processor 138 has circuit blocks 140, 142 and 144 all on the processor 138. In FIG. 3B, the filtering circuit block 140 is located off of the processor 146. The signal 130 is filtered prior to being transmitted to the processor 146, where it is then amplified with the circuit block 142 and processed with the circuit block 144. In FIG. 3C, filtering and processing circuit blocks 140 and 144 are located on the processor 148, while the amplification circuit block 142 is located off of the processor 142.

Figure 4A:
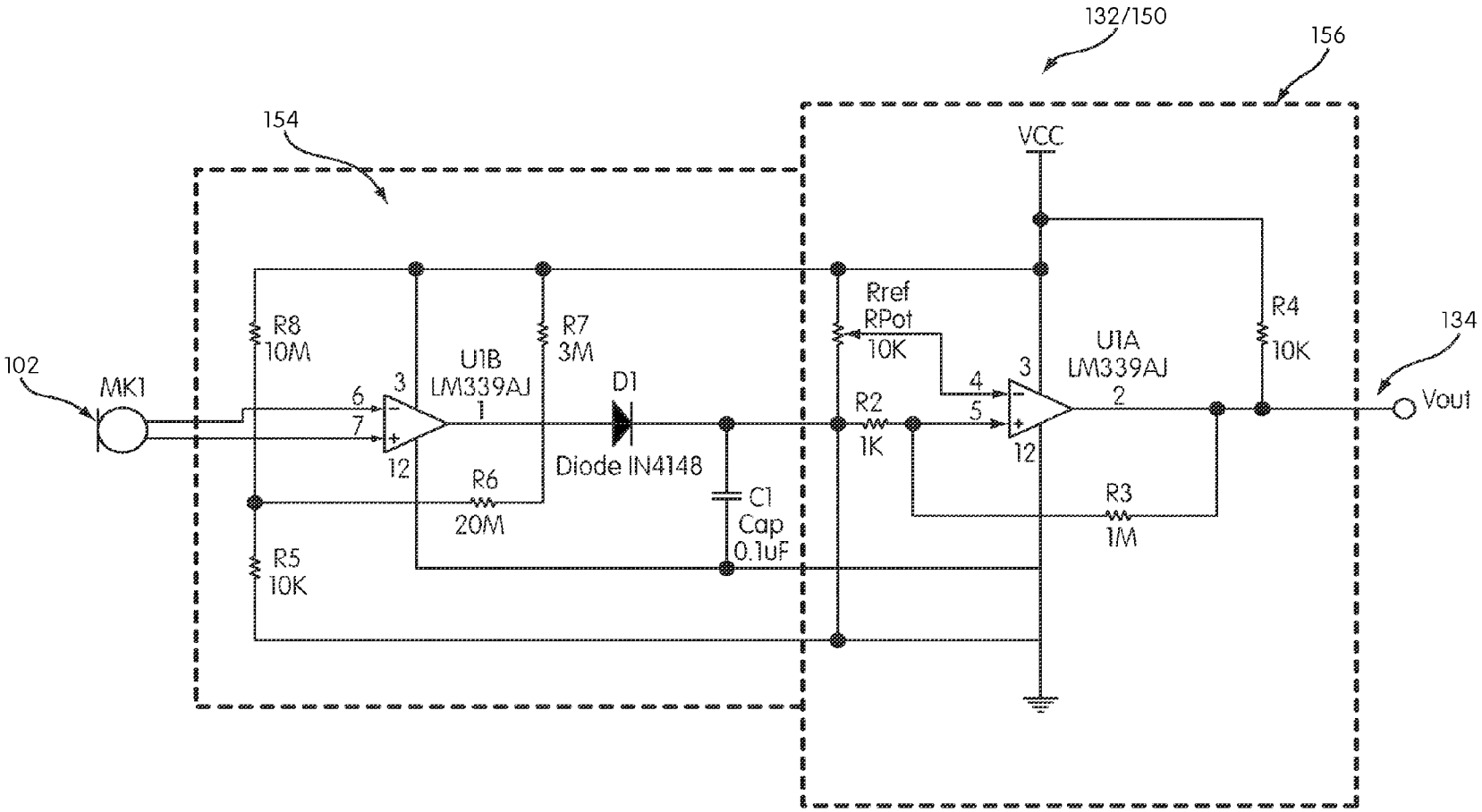
FIGS. 4A and 4B illustrate circuit diagrams of a vibration performance sensor and signal processing circuit according to various embodiments of the present invention.
Figure 4B:
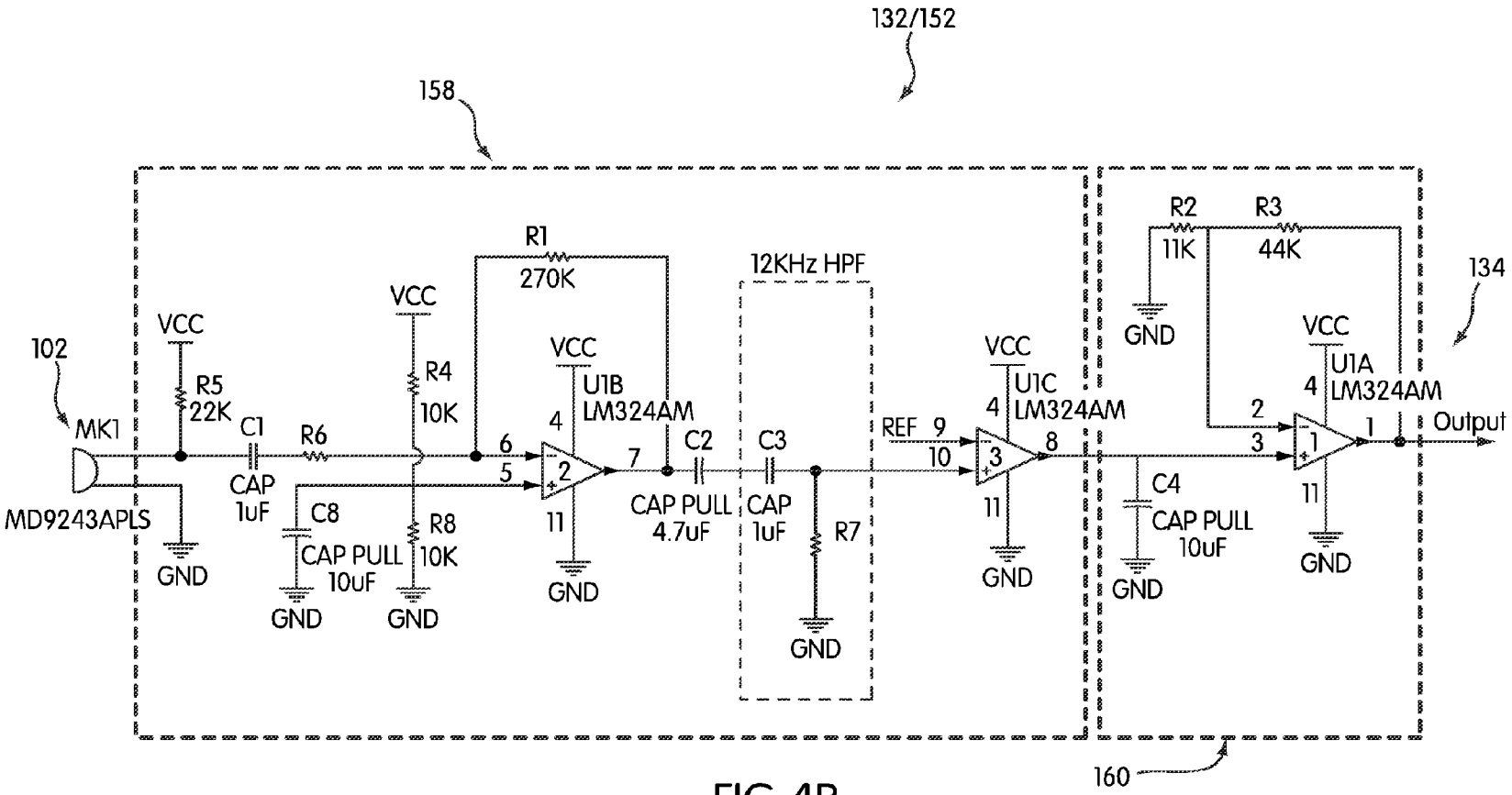

FIGS. 4A and 4B illustrate circuit diagrams 150 and 152, respectively, of a vibration performance sensor 102 and signal processing circuit 132 according to two embodiments of the present invention. The vibration sensor 102 is shown in both FIGS. 4A and 4B. In FIG. 4A, signal processing circuit 132 includes a filter 154 and an amplifier 156. In FIG. 4B, signal processing circuit 132 includes a filter 158 and an amplifier 160. In both circuits 132, the output signal 134 is provided to the controller 104.

In the illustrated embodiments, the controller 104 comprises a control circuit. However, the controller 104 may alternatively comprise any other type of suitable controller without deviating from the scope of the present invention (e.g., a processor executing code; an integrated computer running a program; analog or digital circuitry; etc.).

During the operation of shredder 100, 101, the shredding mechanism 126 vibrates. The vibrations are indicative of the operational state of shredder 100, 101. The determination of the state of shredder 100, 101 with vibration sensor 102 is desirable for many applications. For example, sensed vibrations can indicate whether shredder 100, 101 is operating properly. The controller 104 may determine an operational state of the shredder 100, 100 by analyzing a vibration signal received from the sensor 102. The controller 104 may then regulate the operation of the shredder 100, 101 in response to the determined operational state and associated vibration signal.

For example, a state where there is no vibration from the shredding mechanism 126 would indicate that shredder 100, 101 is in an OFF state. A state where there is minimal vibration from the shredding mechanism 126 would indicate that shredder 100 is in an ON state operating at little or no load. When a mid-level vibration is detected, that can indicate that shredder 100, 101 is in an ON state operating with a medium or large load. A high-level of vibration can indicate that the shredder 100, 101 is not operating in an ideal condition and requires maintenance, such as lubricating the blades/cutter elements that are a common component of shredding mechanisms 126. Sensing these vibrations with sensor 102 enables controller 104 to determine the state of shredder 100, 101. In addition, the amount of vibration within shredder 100, 101 can indicate the amount of noise emanating from shredder 100, 101.

High-vibration levels may indicate to controller 104 that shredder 104 requires lubrication and/or other maintenance. According to one embodiment, a high frequency squeak may indicate metal-on-metal noise and demonstrate that the cutter elements of the shredding mechanism 126 should be lubricated. The controller 104 may automatically lubricate the shredding mechanism in response to such a signal.

Sensed vibrations can indicate the amount of paper being shredded by shredder 100, 101 (i.e. the load on shredder 100, 101). A characteristic of the vibrations may be correlated to the amount of material being shredded (e.g., proportional, inversely proportional, etc.). The sensed vibrations can therefore be used to proportionally determine the load on the shredder mechanism 126 (as opposed to merely making a binary determination of whether or not material is being shredded). According to various embodiments, the controller 104 and sensor 102 may additionally and/or alternatively be used to make a binary determination of whether material is being shredded.

Vibration frequency may be proportional to the speed of the motor of the shredding mechanism 126 such that the sensor 102 may be used to determine the motor's speed. Low frequency vibration/motor speed may indicate that the shredder 100, 101 is jammed, heavily loaded, or overloaded. High frequency vibration/motor speed may indicate that materials 124 are not being fed into the shredding mechanism 126 (sometimes referred to as run-on or free-running of the motor).

In the auto feed shredder 101, which includes an auto-feed system 131 where paper is automatically fed into shredder 101 for shredding, knowing whether the paper is actually feeding into shredder 101 from the bin 129 is useful. By sensing the vibrations within shredder 101, controller 104 can ascertain whether the paper 124 is actually being auto fed into the shredder 101 and shredded by the shredding mechanism 126. If the paper 124 is not being properly fed or shredded, the controller 104 can issue an error malfunction message or perform an autocorrect operation. An autocorrect operation is an operation where shredder 101 would attempt to reload the paper on its own to reattempt the shredding process (e.g., run a drum 131*a* of the autofeed mechanism 131 in reverse, turn a vacuum mechanism of the autofeed mechanism 131 off and on). If such an autocorrect operation fails, the controller 104 may then issue an error and/or malfunction message, for example via display 119, as shown in FIG. 2, and turn the shredder 101 off (e.g., deactivating the motor 126*a* of the shredding mechanism 126 and the autofeed mechanism 131).

Similarly, the sensor 102 and controller 104 can be used to determine whether the paper bin 129 of the shredder 101 is empty. If the sensor 102 and controller 104 sense that paper 124 is not being shredded, but that the shredder 101 is operating properly (e.g., the motor 126*a* is running), the controller 104 determines that the bin 129 is empty and then turns the shredder 101 off.

In addition to determining whether shredder 100, 101 is shredding or not, or determining the overall load on shredder 100, 101 or whether shredder 100, 101 requires maintenance, sensing vibrations is also useful for performing a diagnostic analysis on shredder 100, 101 during manufacturing or when deployed in the field. For example, a vibration profile can be taken from an ideal shredder 100, 101 operation under normal conditions in a variety of circumstances. That profile can then be compared to the vibration profile of every other shredder 100, 101 manufactured to determine if it meets with quality control tolerances. Deviations from the ideal vibration profile may indicate a manufacturing defect. Thus, the vibration profile can be used to create a PASS/FAIL quality control test during manufacturing. In addition, during this factory testing, the vibration parameters of individual shredders 100, 101 may be calibrated to set baseline vibrations that are specific to the shredder 100, 101 being tested.

The sensed vibrations within shredder 100, 101 may also be used to enable a user to regulate the noise level of shredder 100, 101. When shredding materials 124, shredders 100, 101 can often produce a large amount of noise. As shredders 100, 101 are often located in areas where people want to verbally communicate with others in an office or over a telephone, it is often desirable to limit the noise produced by shredder 100, 101. Often the noise produced by shredder 100, 101 is based upon the speed at which shredder 100, 101 operates. Heavy shredding loads often require shredders 100, 101 to operate at a slower, and hence quieter, speed. Light shredding loads enable shredders 100, 101 to operate at a faster, and hence louder, speed. Also, with lighter paper/material loads, there are fewer sheets and tends to be more paper flapping or "chatter," while with heavier paper/material loads there are more sheets and tends to be less flapping or "chatter." By sensing the amount of vibration within shredder 100, 101 with sensor 102, controller 104 can regulate the speed of shredder 100, 101 (including, for example, the motor 126*a* and/or autofeed mechanism 131) so that it does not exceed a predetermined noise level while shredding materials. The shredder 100, 101 may include an input 127 (e.g., slide switch, rotary knob, or other user input device) (see FIG. 1A) to enable a user to indicate the desired maximum noise level. The controller 104 then monitors the vibrations and adjusts the speed of the shredding mechanism 126 and/or autofeed mechanism 131 accordingly to provide as efficient shredding as possible while keeping the noise level below the desired maximum noise level. According to one or more embodiments, the controller 104 comprises a feedback loop that incorporates the detected vibrations as an input, the motor 126 operating state (e.g., motor speed, current, voltage, etc.) as an output, and the desired maximum noise level as a goal of the feedback loop. The shredder 100, 101 may also include an active noise dampening system that can be turned on or turned up to compensate for the increased noise associated with larger levels of sensed vibrations. The user may temporarily set the input 127 to a lower noise setting (e.g., during a telephone conversation).

In the above-discussed embodiment, the input 127 allows a user to select the desired maximum noise level on a sliding scale between quieter, slower operation and louder, faster operation. Alternatively, the input 127 may simply be a "quiet" button that, when activated, reduces the shredder's noise level to below a preset threshold that is preprogrammed into the shredder's controller 104.

The controller 104 may be configured to regulate operation of the shredder by issuing a message to the user when the controller 104 determines that a particular shredder event has occurred. The message may be visual (e.g., displayed message on the display 119, an illuminated LED next to a permanent message indicating the significance of the LED being illuminated) and/or audible (e.g., via a speaker that provides a verbal or otherwise audible message). For example, if the controller 104 determines that a material (e.g., paper) jam has occurred, it may cause the display 119 to read "ERROR," "PAPER JAM," or "MATERIAL JAM," and/or it may cause a verbal "ERROR," "PAPER JAM," or "MATERIAL JAM" message or non-verbal sounds (e.g., beeps) to be issued. Events may additionally and/or alternatively include any other event for which an associated visual or audible message would be desirable (e.g., shredded paper bin full, input bin empty, lubrication needed, maintenance required, shredding mechanism overload, autofeed mechanism malfunction (e.g., paper not being fed correctly into the shredding mechanism by the autofeed system), motor overload, input overload (e.g., too many sheets of paper being fed into the shredding mechanism), estimated load on shredder (e.g., estimated number of sheets being fed into the shredder 100, 101)). As explained elsewhere, the controller 104 may additionally and/or alternatively take corrective action in response to sensing such events.

The controller 104 may determine/estimate from the sensed vibrations a thickness of material being shredded (e.g., how many sheets are being fed into the shredder 100, 101, an actual thickness of material such as in inches, millimeters, etc.). The controller 104 may display the estimated thickness (e.g., sheet count) on the display 119, provide a visual and/or audible warning when the sensed thickness is excessive (e.g., exceeds the shredder's intended sheet/thickness capacity), and/or take corrective action when an overly thick amount of material (e.g., too many sheets) is being fed into the shredder 100, 101 (e.g., operating in reverse to remove the excess paper/material).

Figure 5:
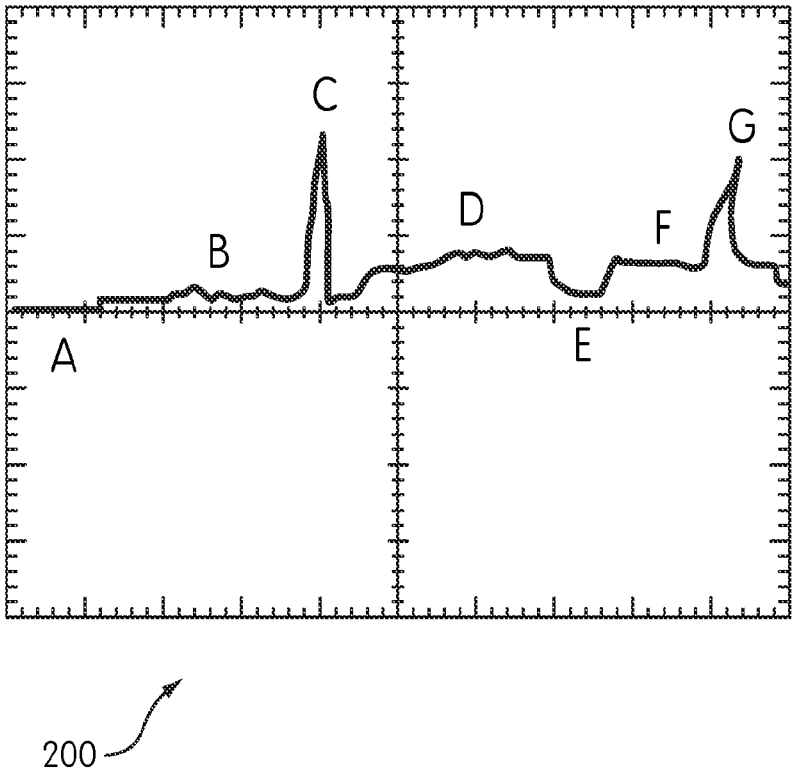
FIG. 5 illustrates an acoustic wave graph produced by a nominal shredding of a paper document as detected by a vibration performance sensor with an analog signal processing circuit according to an embodiment of the present invention.

FIG. 5 illustrates an acoustic wave graph 200 produced by a nominal shredding of a paper document 124 as detected by vibration performance sensor 102 with an analog signal processing circuit 132 according to an embodiment of the present invention. Graph 200 depicts the voltage level of a vibration sensor signal representing the amount of vibration within shredder 100, 101 during various states of operation. Minimal filtering is used in circuit 132 to produce graph 200. In region A on graph 200, little or no vibration signal is present, thereby indicating that shredder 100, 101 is in an OFF state and is not shredding any materials. In region B on graph 200, a small amount of vibration is detected, indicating that shredder 100, 101 is in an ON state and is shredding a minimal amount of paper 124. In region C, a high level of vibration is detected.

This high level of vibration in region C is indicative of mechanical components of shredding mechanism 126 requiring lubrication. In region D, a larger amount of paper 124 is being shredded than in region B, as indicated by the larger amount of vibration. In region E, no paper is being shredded and shredder 100, 101 but the motor is running (called run-on). In region F, paper is being shredded at an amount that is similar to that of region D. In region G, a large signal is detected, similar to that of region C, again indicating that shredding mechanism 126 requires lubrication.

Figure 6:
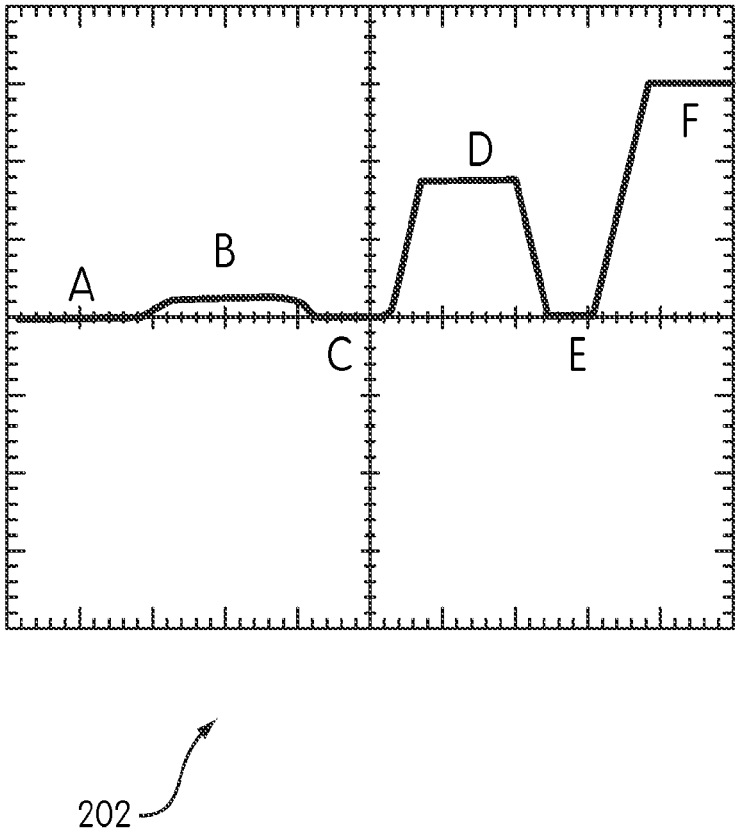
FIG. 6 illustrates an acoustic wave graph produced by a nominal shredding of a paper document as detected by a vibration performance sensor with an analog signal processor according to an embodiment of the present invention.

FIG. 6 illustrates an acoustic wave graph 202 produced by a nominal shredding of a paper document 124 as detected by the vibration performance sensor 102 with an analog signal processor 132 according to an embodiment of the present invention. In contrast to graph 200 in FIG. 5, graph 202 is produced using a circuit 132 that includes filtering to remove noise and audio frequencies that are not of interest. In regions A, C, and E on graph 202, little or no vibration signal is present, thereby indicating that shredder 100, 101 is in an OFF state and is not shredding any materials. In region B on graph 202, a small amount of vibration is detected, indicating a low load (e.g., the shredder 100, 101 is in an ON state and is shredding a minimal amount of paper 124). In region D, moderately higher vibrations indicate a moderate load (e.g., the shredder 100, 101 is shredding a moderate amount of paper 124). In region F, high vibrations indicate a heavy load (e.g., the shredder 100, 101 is shredding a large amount of paper 124).

Figure 7:
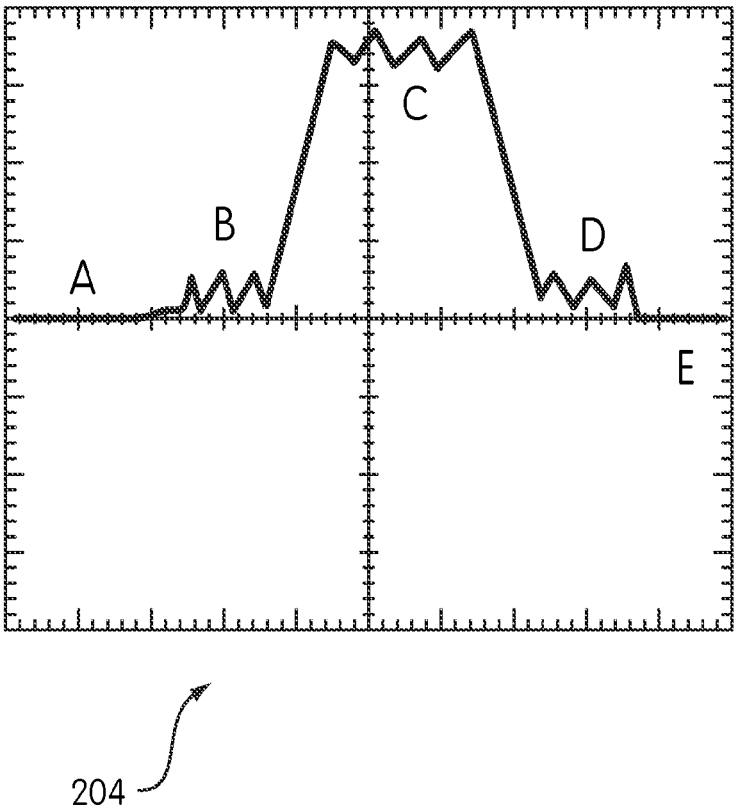
FIG. 7 illustrates an acoustic wave graph produced while shredding a document with a shredder according to an embodiment of the present invention.

FIG. 7 illustrates an acoustic wave graph 204 produced while shredding material 124 with a shredder 100, 101 according to an embodiment of the present invention. Graph 204 is produced from an output from an analog circuit 132 that includes filtering to remove noise and audio frequencies that are not of interest. In region A of graph 204, shredder 100, 101 is in an OFF state. In region B of graph 204, shredder 100, 101 is in an ON state where shredding mechanism 126 is operating without any load being placed on it. In region C of graph 204, shredding mechanism 126 is operating with a heavy load being placed on it. In region D of graph 204, a lower load is being applied to shredding mechanism 126 than in region C. Then in region E, shredder 100, 101 is once again in an OFF state. FIGS. 5, 6 and 7 illustrate acoustic wave graphs 200, 202 and 204 produced with analog circuitry. It is contemplated that digital circuitry may also be used for circuit 132, which would correspondingly result in discretized versions of graphs 200, 202 and 204.

In FIGS. 5-7, the x-axis represents time, and the y-axis represents amount of vibration (in terms of either amplitude or frequency, depending on the specific shredder 100, 101).

Table 1 below is a function table describing exemplary actions that controller 104 may take in response to a particular vibration signal detected by vibration sensor 102. Output messages outputted by controller 104 may be displayed on a visual display 119 provided, for example, on panel 118 of shredder 100, 101.

TABLE 1

| Vibration Level Detected By Sensor 102 | Event Indicated By Detected Level of Vibration | Exemplary Action Taken by Controller 104 |
|---|---|---|
| Little or no vibration | Shredder 100, 101 is OFF | Nothing, or output message stating machine is OFF or IDLE |
| | In cases where shredder 101 has an auto feed feature, this can indicate that the shredder 101 has been misfed and/or that the auto feed mechanism 131 has malfunctioned | Turn shredding mechanism 126 OFF and output a misfeed message, or perform an autocorrect operation to refeed the materials 124 using the auto feed mechanism 131 |
| Low vibration | Shredder 100, 101 is ON and shredding a light load of materials 124 | Nothing, or output message that machine is ON and SHREDDING |
| Moderate vibration | Shredder 100, 101 is ON and shredding a moderate to high load of materials 124 | Nothing, or output message that machine is ON and SHREDDING |
| High vibration | Shredder 100, 101 is ON and requires lubrication or other maintenance | Stop shredder 100, 101 from operating and output message that machine requires maintenance, or automatically lubricate shredding mechanism 126 and continue shredding |
| Low or moderate vibration followed by a sharp drop in vibration | Shredder 100, 101 has experienced a jam | Stop shredding mechanism 126 and output a warning message indicating a paper jam, OR<br>Perform an autocorrect operation (e.g., operate the shredding mechanism 126 in reverse to clear a paper jam; operate the auto feed mechanism 131 (e.g. autofeed drum 131a in reverse to clear out jammed paper; toggle autofeed vacuum device between on and off (and, according to various embodiments, provide positive pressure) to help clear material) |

The level of mechanical vibration produced by shredder 100, 101 can also be used to detect a paper jam. Once the shredder 100, 101 has completely shredded material 124, the shredding mechanism 126 will continue to operate at a much lower load (run-on), thereby producing a much lower amount of vibration, but at a higher frequency. However, if the shredder 100, 101 transitions very abruptly (i.e., within a short, predetermined amount of time) from a level of vibration indicating shredding occurring to no vibration or run-on level vibrations, that would indicate that a paper jam occurred, particularly when the controller 104 determines that the shredder's motor 126*a* should be running.

The sensor 102 and controller 104 can also be used to detect and respond to faulty run-on. Motor 126*a* run-on (i.e., continuous no-load operation of the motor 126*a*) can result from an auto on/off shredder's input paper detector (e.g., throat paper detector 125, autofeed input bin detector 133) falsely detecting the presence of material to be shredded. Such paper detectors 125, 133 are typically used to turn the motor 126*a* on when the detector 125, 133 senses that paper or other material is being fed into the throat 120 of the shredder 100 or the autofeed mechanism 131 of the shredder 131, and then turn the motor 126*a* off again a predetermined time after the detector senses that material is no longer being fed into the throat 120 of the shredder 100 or the autofeed mechanism 131 of the shredder 131. Such detectors 125, 133 may falsely sense the presence of material to be shredded under certain conditions (e.g., if shredded material dust builds up on a beam-break detector 125, 133, if material to be shredded is stuck in the throat 120 or autofeed input bin 129, but is prevented from reaching the shredding mechanism 126). During such a malfunction, the detector 125, 133 senses that material is being fed into the shredding mechanism 126 despite the fact that no material is in fact being fed into the shredding mechanism 126. In such a malfunction state, the controller 104 continuously runs the unloaded motor 126*a*, which may eventually damage the motor 126*a* or shredder 100, 101, or cause the shredder 100, 101 to overheat. According to various embodiments of this invention, the controller 104 uses the sensor 102 to detect and respond to such malfunctions. For example, the controller 104 may use the sensor 102 to detect prolonged run-on (e.g., by detecting quieter, higher frequency vibrations that indicate run-on), and respond accordingly. For example, if the controller 104 detects run-on for over a predetermined threshold time (e.g., 5, 10, 20, 30, 60 seconds or more), the controller 104 can be configured to: (a) attempt to unjam the throat 120 or input bin 129 using any of the unjamming techniques discussed herein; (b) turn off the motor 126*a* either initially, or in response to a determination that the unjamming techniques did not work; and/or (c) provide an error indication to the user via any of the techniques described herein.

The controller 104 may determine that the paper detector 125, 133 has malfunctioned if, for a predetermined time period, the detector 125, 133 indicates the presence of material to be shredded while the sensor 102 indicates run-on (no material being shredded). In such a case, the controller 104 may provide an error message and/or instructions to the user via any of the techniques described herein. For example, the controller 104 may indicate to the user that the detector 125, 133 has malfunctioned. In an embodiment that uses a beam-interrupt detector 125, 133, the controller 104 may instruct the user to clear dust/debris away from the detector's emitter or sensor. The controller 104 may additionally and/or alternatively instruct the user to remove from the shredder 100, 101 material that is blocking the detector 125/133, but is not being fed into the shredding mechanism 126.

The mechanical vibration of shredder 100, 101 will vary depending upon the amount of shredded material that is contained within body 106. As the amount of mass within body 106 increases, the mechanical vibrations within shredder 100, 101 during operation will vary. Thus, utilizing this vibration signal 128 during normal operation, controller 104 can determine the amount of shredded paper contained within body 106. Once the amount of paper contained within body 106 reaches a particular level as indicated by a particular vibration, the controller 104 can issue a message indicating that the body 106 is full of shredded paper and that it requires disposal. The controller 104 may disable operation of the shredder 100, 101 until the shredded paper bin of the body 106 is emptied.

According to different shredders (e.g., shredders with different shredding mechanisms (e.g., different sized motors, weights, mounting characteristics, different vibration dampening characteristics), different bins, different throat opening configurations, different sensor 102 positions), different frequencies and/or amplitudes of vibration, different changes in the frequencies and/or amplitudes of vibration, and/or different accelerations in changes in the frequencies and/or amplitudes of vibration may indicate different specific events and/or faults. In some shredder motor types, vibration amplitude is a function of load (e.g., amount of paper being fed into the shredding mechanism). For example, in typical induction motors, vibration amplitude may be proportional to load. In typical universal motors, on the other hand, vibration amplitude may be inversely proportional to load. In some motor types (e.g., typical universal motors), vibration frequency is a function of load (e.g., proportional or inversely proportional). However, it should be noted that there are various exceptions to these typical vibration/load relationships.

The vibration-to-shredder-event relationship may also be affected by, among other things, the number and type of cutting tips of the cutting cylinders of the shredding mechanism, whether the shredder is a cross-cut or strip cut shredder, shredder speed, gear types, etc. The controller 104 is therefore preferably designed to associate such vibration occurrences with events for the particular shredder or type of shredder in which the sensor 102 and controller 104 are used. The graphs in FIGS. 5-7 are for particular shredders. Other shredders may have quite different vibration graphs.

To account for such variations in shredder vibration between different shredders, the controller 104 may be specifically tailored to detect shredder events in a particular shredder and/or type of shredder. The controller 104 is configured to accordingly regulate the operation of the shredder 100, 101 in response to the detection of such shredder events. Moreover, the controller 104 may be tailored to detect specific events (e.g., detect a high frequency squeak indicative of the need for lubrication; detect lower frequency vibrations associated with motor load).

The controller 104 may additionally and/or alternatively be configured to monitor for a combination of vibration and other events, and regulate the shredder 100, 101 accordingly. For example, as shown in FIG. 2, the shredder 101 may include a feed bin sensor 133 (e.g., photo sensor, beam-break sensor, etc.) that senses the presence of materials 124 in the input bin 129. If, during operation of the shredder 101, the feed bin sensor 133 indicates that there are materials 124 in the input bin 129, but the sensor 102 indicates that no materials 124 are being shredded and the controller 104 determines that the shredder's motor is running, the controller 104 may determine that there is an autofeed fault. If, during operation of the shredder 101, the feed bin sensor 133 and sensor 102 both indicate that there are no materials 124 to be shredded/being shredded, then the controller 104 may determine that the shredding operation has been completed and turn off the motor of the shredding mechanism 126.

Additionally and/or alternatively, the sensor 102 and controller 104 may be used to detect any one or more of the following shredder events: motor overload, shredder stall, jam, squeaks indicating the need for lubrication, whether the shredder is shredding materials, extent of load (e.g., estimated sheet count being fed into the shredder), autofeed malfunction, etc. The controller 104 may then provide shredder event information to the user (e.g., audibly via a speaker; visually via the display 119) and/or take responsive action.

The controller 104 may use a variety of one or more mechanisms to isolate vibrations associated with a particular shredder 100, 101 event from other vibrations. For example, the controller 104 may isolate vibrations of interest via the filters 140, 158, which may be constructed and configured to filter out unwanted, predetermined types of vibrations (e.g., vibrations with unwanted frequencies, amplitudes, etc.). Alternatively and/or additionally, the controller 104 may isolate relevant vibrations of a predetermined type when sensing for a particular event by only analyzing vibrations of a relevant, predetermined type (e.g., only analyzing frequencies within a predetermined frequency range, for example, frequencies above a threshold, below a threshold, and/or within a band), which are associated with such an event. The controller 104 may use any suitable mechanism for performing such isolation (e.g., analog or digital processing, suitable transforms, high pass filters, low pass filters, band pass filters, etc.).

According to one embodiment, the controller 104 isolates vibrations emanating from the shredding mechanism 126 itself from other vibrations such as the noise generated by the tearing and crinkling of material being shredded. According to some embodiments, vibrations created by the shredded material, itself, is dependent on the type and amount of material being shredded. For example, a CD, a piece of paper, and a piece of cardboard will all make much different noises than each other when being shred. Such variations in material-generated noise make it more difficult to analyze a shredding mechanism 126 event using unpredictable material noises. By isolating shredding mechanism 126 noises (e.g., frequencies generated by the shredding mechanism 126) from such material noises (e.g., frequencies and/or frequency ranges generated by a variety of materials being shredded), the controller 104 can better detect shredder 100, 101 events associated with shredding mechanism 126. Conversely, the controller 104 may isolate noises generated by the material from noises generated by the shredder 100, 101 in order to analyze the material being shredded (e.g., to determine the type and/or amount of material being shredded). According to one or more embodiments, the vibration frequencies generated by the shredding mechanism 126 are lower than the frequencies typically generated by material being shredded. In such embodiments, a low pass filter may be used to filter out higher frequencies.

The shredder 100, 101 has baseline vibration characteristics that include the vibrations generated by the shredder 100, 101 when the shredder's motor is running, but materials are not being fed into the shredding mechanism 126 and no other shredder event or fault is occurring. Such baseline vibration characteristics of the shredder 100, 101 may change over time as various shredder components wear in and wear out. For example, gears in the shredding mechanism 126 may wear down, increasing their backlash and chatter. Cutters of the shredding mechanism 126 may become dull over time, changing the vibrations generated as the cutters shred material. Vibrations of the motor of the shredding mechanism 126 may change as the motor's bearings, brushes, etc. wear out. Connections between the shredding mechanism 126 and the shredder's housing may loosen, thereby changing how the shredder 100, 101 vibrates. To account for such gradual changes in the shredder's baseline vibration characteristics, the controller 104 may be programmed or otherwise configured to adjust for these gradual changes over time, such as by executing a calibration operation.

According to one embodiment, the controller 104 adjusts for time-based or use-based changes to the shredder's baseline vibrational characteristics via a preprogrammed vibration change profile. The profile may shift the amplitude, frequency, or other vibration characteristic associated with one or more particular shredder events as a function of time (e.g., absolute time based on a clock connected to the controller 104), shredder usage time (e.g., a clock that advances only while the shredding mechanism 126 and motor are running), and/or any other relevant parameter (number of total sheets shredded, as determined by the controller 104 or entered by a user). The profile may be generated in a controlled testing environment and then utilized by all shredders having the same or similar baseline vibration characteristics as the tested shredder. The profile may provide for continuous, proportional shifts over time or use, or may include quantum changes to the vibrational threshold characteristics at various particular times. For example, if the controlled testing indicates that baseline shredder vibration increases over time, the profile may proportionally increase a vibration threshold/characteristic that indicates a particular shredder event.

According to another embodiment, the controller 104 in each shredder 104 may learn the shredder's baseline vibration characteristics over time and track deviation during normal usage (e.g., during run-on) so as to continuously generate and implement a change profile as the shredder 100, 101 is used. This tracked deviation from baseline vibration characteristics can be used to self-adjust the vibration signatures/characteristics associated with particular shredder events, track and record anomalies in shredder behavior over an extended time frame for maintenance and repair purposes, enable the controller 104 to filter out additional background noise, etc. Such continuous re-zeroing or recalibrating of the baseline vibration characteristics of a particular shredder 100, 101 may facilitate greater sensitivity and noise cancellation by the controller 104 so as to continuously improve the controller's ability to detect and identify shredder events. It may enable the controller 104 to filter out background noise that is not of interest in identifying pertinent shredder events.

According to another embodiment, the controller 104 compares sensed vibrations during each shredder 100, 101 run-on period to existing baseline vibration characteristics in a memory of the shredder 100, 101. When the shredder 100, 101 senses that paper or other material is no longer being fed into the shredder 100, 101 (e.g., as a result of a throat sensor no longer detecting the presence of paper/material in the throat), the controller 104 continues to run the shredding mechanism's motor for a short time period (e.g., 10 seconds) to ensure that all paper/material has passed through the shredding mechanism 126. At the end of the run-on period, the controller 104 turns the motor off until the throat sensor (or other sensor) detects that additional paper/material is being fed into the shredding mechanism 126. In general, such sensed vibration data during the run-on period provides reliable data regarding the vibrations of the shredder 100, 101 when the motor is running but paper/material is not being shredded. If the sensed vibration characteristics during this run-on period deviate from the existing baseline vibration characteristics by more than a predetermined minimum deviation amount, then the controller 104 stores the sensed vibration characteristics in the memory as the new existing baseline vibration characteristics, and updates the vibration thresholds associated with various shredder events to account for this change in baseline vibrations. Thus, the run-on period can be used as a calibration operation, as it is a known period with no paper or other material being fed into the shredder 100, 101. For example, the controller 104 may increase a vibrational threshold indicative of a certain shredder event by the difference between the previous baseline vibration characteristics and the new baseline vibration characteristics. However, other relationships may be used to correlate specific changes to the baseline vibration characteristics to appropriate changes to the threshold values associated with various shredder events without deviating from the scope of the present invention (e.g., predetermined change profile based on laboratory testing). By updating the baseline vibration characteristics and shredder event vibration thresholds only when the baseline vibrations deviate by a minimum predetermined amount, the controller 104 can avoid rewriting the baseline and threshold values after every run-on period, thereby prolonging effective memory life. However, according to an alternative embodiment, the controller 104 may update the baseline and threshold values after each run-on period without deviating from the scope of the present invention.

The controller 104 may also be configured to identify and ignore sensed run-on vibrations that deviate too much from the baseline vibration characteristics, which may indicate a shredder event rather than normal baseline vibrations. Thus, if the deviation between the sensed run-on vibrations and the existing baseline vibration characteristics exceeds a preset maximum deviation amount, the controller 104 discards such sensed vibrations and does not use them to update the baseline vibration characteristics or thresholds. The preset maximum vibration deviation used for discarding the vibration data is preferably, but not necessarily, chosen to be larger than the expected normal deviation of the vibrations in the shredder over the relevant time frame, and smaller than the deviation that would indicate a shredder event other than normal run-on operation. The controller 104 may record each time that the present maximum vibration deviation is exceeded during run-on to indicate a fault condition. If the controller 104 determines that the preset maximum vibration deviation has been exceeded consistently for a predetermined number of run-ons, the controller 104 may determine that the deviation was not, in fact, a fault condition indicating a shredder event, and consequently use the sensed vibrations to update the baseline vibration characteristics and shredder event thresholds despite the fact that the sensed vibrations exceeded the preset maximum deviation.

Figure 8A:
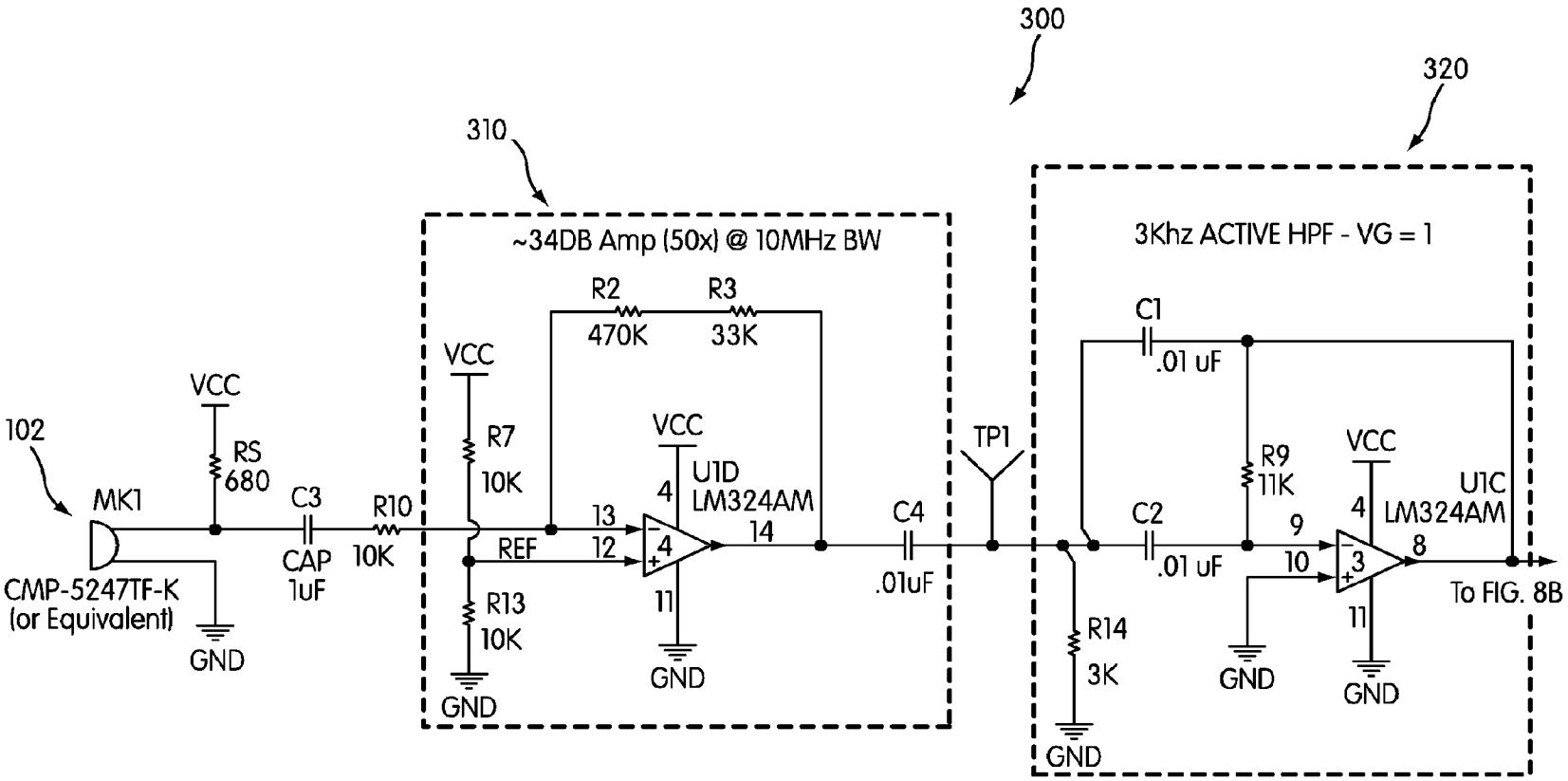
FIGS. 8A and 8B illustrate a circuit diagram of a vibration performance sensor and signal processing circuit according to an alternative embodiment of the present invention.
Figure 8B:
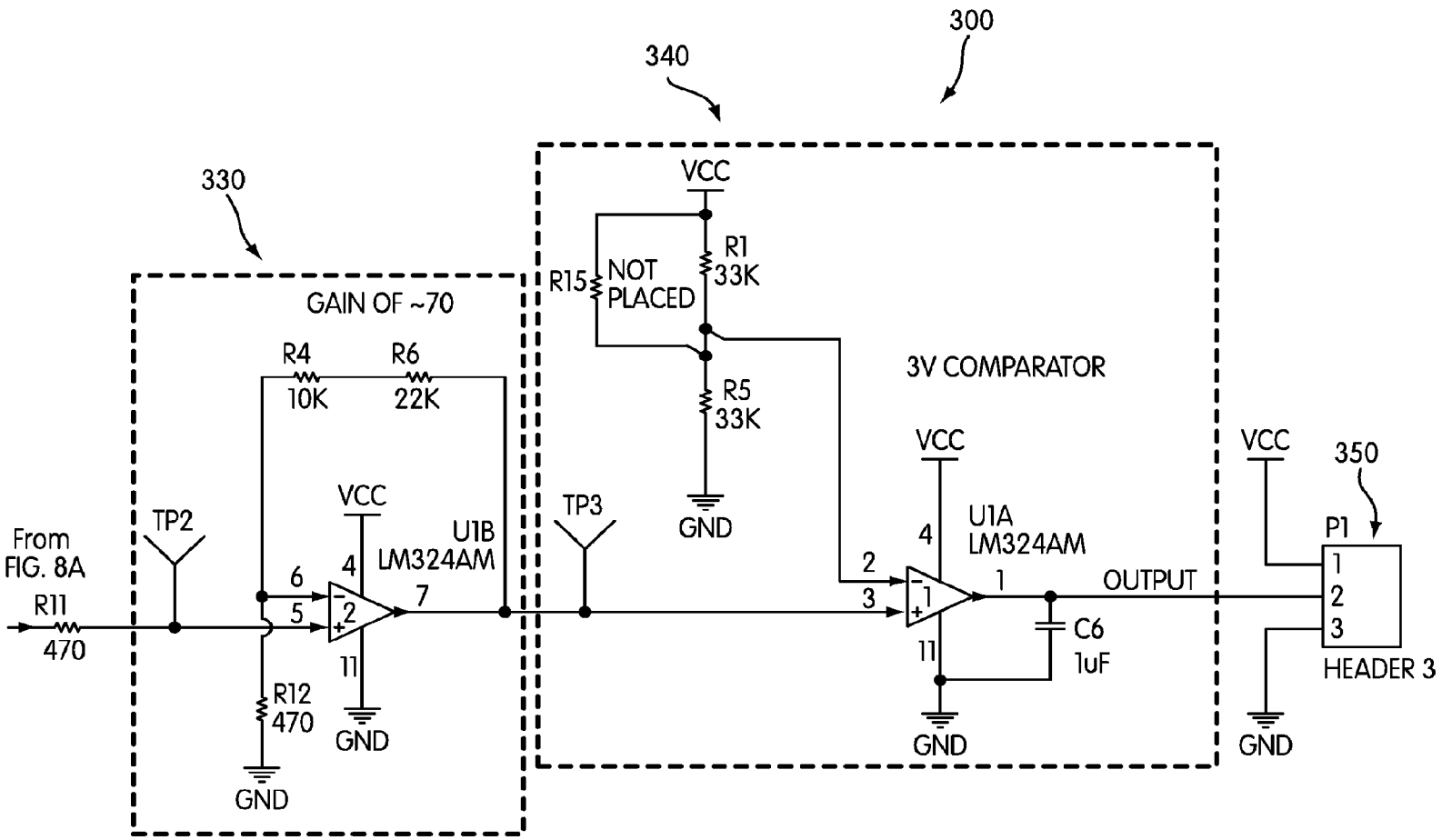

FIGS. 8A and 8B illustrate a circuit diagram of a controller 300 for the shredder 100, 101 according to an alternative embodiment. The controller 300 includes a pre-amplifier 310 (e.g., a −34DB Amp (50×) @ 10 MHz BW), a high pass filter 320 (e.g., a 3 Khz HPF−VG=1), an amplifier 330 (e.g., an amplifier with a gain of ~70), a comparator 340, and a processor 350. The vibration sensor 102 (e.g., a CMP-5247TF-K microphone) generates a detected vibration signal that then passes sequentially through the pre-amplifier 310, the high-pass filter 320, and the amplifier 330. According to this embodiment, the 3 KHz high pass filter 320 and amplifiers 310, 330 provide a signal that is correlated to whether the shredder is actually shredding material in one embodiment of the shredder, and provides a useful signal across a wide range of shredded materials (e.g., CDs, thin paper (60 gm), card stock, transparencies, junk mail, etc.).

The filtered, amplified signal then reaches the comparator 340, at which point the signal is compared to a predetermined signal (e.g., 2.5 V, 3 V). If the signal exceeds the predetermined signal level, the comparator 340 outputs a signal that is proportional to the input signal. If the signal falls below the predetermined signal level, the comparator 340 outputs a low (or zero) signal (e.g., 0 volts). The comparator 340 is used to filter out low amplitude vibrations that are known not to be indicative of material being shredded. The comparator 340 may function like a high-amplitude-pass filter/amplifier (as opposed to a high-frequency-pass filter such as the filter 320).

As shown in FIG. 8B, a capacitor downstream from the comparator 340 evens out the signal output by the comparator 340 to reduce the effect of rapid, random changes in the signal.

The processor 350 then receives the analog signal output from the comparator 340. The processor 350 takes an 8 sample running average of the analog signal (e.g., in terms of voltage), for example, by recording successive analog signal readings (e.g., amplitude in terms of volts) to an 8 data point first-in-first-out array. The processor 350 calculates an average of the last 8 samples, and compares the averaged signal (e.g., in terms of volts that are proportional to an amplitude of the detected vibrations) to a predetermined threshold vibration level. If the averaged signal is below the predetermined threshold vibration level, which tends to indicate that material is not being shred, the processor 350 determines that the shredder 100, 101 is not currently shredding material. If the averaged signal is above the predetermined threshold vibration level, which tends to indicate that material is being shred, the processor 350 determines that the shredder 100, 101 is currently shredding material.

The processor 350 may alternatively use greater or fewer (e.g., 1, 2, 3, or 4 samples) samples to generate the averaged signal without deviating from the scope of the invention. The processor 350 may separately use each sample to determine if material is being shred, so that no average is taken. The number of samples may be chosen based on the clock speed of the processor, the expected time over which the signal changes between detecting and not detecting that material is being shred, and/or other considerations.

As a further filter, the processor 350 according to one or more embodiments only determines that material is being shredded if the running 8 signal average stays above the predetermined threshold vibration level continuously for a preset period of time (e.g., 0.1 seconds, 0.25 seconds, 0.5 seconds, 1 second, 5 consecutive signals or averaged signals, 10 consecutive signals or averaged signals, etc.).

The processor 350 includes a timer that is started when the processor 350 determines that material is being shred (e.g., because the averaged signal exceeds the predetermined threshold vibration level, and/or exceeds the threshold continuously for a predetermined time period). The timer is restarted each new time the processor 350 determines that material is being shred. If the timer passes a preset time period/delay (e.g., 5 seconds, 10 seconds, 15 seconds) while the shredder's input paper/material detector (e.g., throat paper detector 125, autofeed input bin detector 133) detects that material is being fed into the shredding mechanism 126, the processor 350 determines that a material jam or other fault has occurred. The processor 350 may responsively turn off the shredder 100, 101 (e.g., the motor 126*a*), and/or initiate an autocorrect sequence (e.g., running the shredding mechanism 126 in reverse, toggling the shredding mechanism 126 between forward and reverse multiple times, turning a vacuum or fan of an autofeed mechanism 131 on and off, taking one or more such corrective steps a predetermined number of times (e.g., 2, 5, 7), etc.). The processor 350 may then assess whether the autocorrect sequence succeeded. If the autocorrect sequence did not cause the shredder's input paper detector (e.g., throat paper detector 125, autofeed input bin detector 133) and the processor's analysis of the detected vibrations to agree that either material is being shred or material is not being shred, the processor 350 may conclude that (1) there is a jam that requires additional attention and cannot be cleared by the shredder 100, 101 itself, or (2) there is an erroneous signal being generated by the shredder's input paper detector (e.g., throat paper detector 125, autofeed input bin detector 133) or the vibration sensor 102 and accompanying circuitry. In response to such a fault determination, the processor 350 may turn the motor 126*a* and/or other parts of the shredder 100, 101 off and provide an error indication.

When the shredder 100, 101 and controller 300 is calibrated at the factory, the shredder 100, 101 is run at no load so that the controller 300 learns the no load baseline vibration level of the exact shredder 100, 101. The predetermined threshold vibration level is then set to be slightly higher than the no-load baseline vibration signal level (e.g., a predetermined increase (e.g., 0.5 volts if signal amplitude is being measured in volts (which are correlated to amplitude of the detected vibrations). After each use/shredding event of the shredder 100, 101, the controller 300 relearns the baseline no load vibration level during known run-on (e.g., the average detected vibration level 1, 2, 3, 4, 5, or more seconds after the shredder's input paper detector (e.g., throat paper detector 125, autofeed input bin detector 133) detects that material is not being fed into the shredding mechanism 126). The time delay is used to ensure that material clears through the shredding mechanism 126 prior to the processor's recalibration of the no load vibration level. This baseline vibration level may decrease or (more likely) increase over time as a result of, for example, aging gear noise, vibrating plastic, etc. The controller 300 then resets the predetermined threshold vibration to be slightly above the newly learned no-load baseline vibration level. This recalibration technique enables the shredder 100, 101 to adapt to changes in the shredder's baseline vibration level over time.

According to various embodiments, the amplifiers 310, 330, filter 320, and/or comparator 340 can omitted without deviating from the scope of the present invention. According to one or more such embodiments, the function of such amplifiers 310, 330, filter 320, and/or comparator 340 can be accomplished by the processor 350. The choice between placing such functions in hardware (e.g., the circuits 310, 320, 330, 340) or in the processor 350 is a design consideration, and all such alternatives are encompassed within the scope of the present invention.

Although particular functions and relationships have been described for updating the baseline and threshold vibration levels used by the controller 104, any other suitable function or relationship may be used to control how, when, and the extent to which the baseline and threshold vibration levels are changed during the life of the shredder 100, 101 without deviating from the scope of the present invention.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

We claim:

1. An auto-feed paper shredder comprising:

an input bin configured to hold a stack of paper to be shredded;

a shredding mechanism including an electrically powered motor and interleaving cutter elements, the motor being operable to drive the cutter elements so that the cutter elements shred the paper fed to the shredding mechanism;

an auto-feed mechanism configured to automatically feed paper from the input bin to the shredding mechanism; and a control system comprising a sensor configured to detect vibrations generated by operation of the shredder, and a controller coupled to the sensor and auto-feed mechanism, the controller being configured to regulate operation of the auto-feed mechanism in response to the detected vibrations having a predetermined characteristic.

2. The shredder of claim 1, wherein in response to the detected vibrations exceeding a predetermined vibration level, the controller is configured to regulate operation of the auto-feed mechanism so as to reduce vibrations generated by operation of the shredder while continuing to operate the motor.

3. The shredder of claim 2, further comprising a user input that enables a user to change the predetermined vibration level.

4. The shredder of claim 1, wherein the controller is configured to cause the auto-feed mechanism to perform an autocorrect operation in response to the detected vibrations indicating that paper is not being fed from the input bin to the shredding mechanism.

5. The shredder of claim 4, wherein the autocorrect operation comprises running the auto-feed mechanism in reverse and then running the auto-feed mechanism in forward to automatically feed paper from the input bin to the shredding mechanism.

6. The shredder of claim 4, wherein:

the controller is configured to determine if the autocorrect operation failed; and the controller is configured to turn the shredder off in response to determining that the autocorrect operation failed.

7. The shredder of claim 6, wherein the controller is configured to issue an error message in response to determining that the autocorrect operation failed.

8. The shredder of claim 1, wherein the auto-feed mechanism comprises a rolling drum and vacuum mechanism that are configured to automatically and repeatedly feed paper from the input bin to the shredding mechanism.

9. The shredder of claim 8, wherein the controller is configured to run the rolling drum in reverse in response to the detected vibrations indicating that paper is not being fed from the input bin to the shredding mechanism.

10. The shredder of claim 8, wherein the controller is configured to turn the vacuum mechanism off and on in response to the detected vibrations indicating that paper is not being fed from the input bin to the shredding mechanism.

11. The shredder of claim 1, wherein the controller is configured to run the auto-feed mechanism in reverse in response to the detected vibrations having the predetermined characteristic.

12. The shredder of claim 1, wherein the controller is configured to run the auto-feed mechanism in reverse in response to the detected vibrations falling below a predetermined threshold.

13. The shredder of claim 1, wherein the controller is configured to run the auto-feed mechanism in reverse in response to the detected vibrations indicating that paper is not being fed into the shredding mechanism.

14. The shredder of claim 1, wherein the sensor is configured to detect vibrations generated by the auto-feed mechanism.

15. The shredder of claim 1, wherein the controller is configured to adjust the speed of the auto-feed mechanism in response to the detected vibrations having the predetermined characteristic.

16. A method of using an auto-feed paper shredder that includes an input bin configured to hold a stack of paper to be shredded, a shredding mechanism including an electrically powered motor and interleaving cutter elements, the motor being operable to drive the cutter elements so that the cutter elements shred the paper fed to the shredding mechanism, an auto-feed mechanism configured to automatically feed paper from the input bin to the shredding mechanism, a vibration sensor configured to detect vibrations generated by operation of the shredder, and a controller coupled to the sensor and auto-feed mechanism, the method comprising:

detecting, via the vibration sensor, vibrations generated by operation of the shredder during operation of the shredder; and automatically regulating, via the controller, operation of the auto-feed mechanism in response to the detected vibrations having a predetermined characteristic.

17. The method of claim 16, further comprising:

in response to the detected vibrations exceeding a predetermined vibration level, regulating, via the controller, operation of the auto-feed mechanism so as to reduce vibrations generated by operation of the shredder while continuing to operate the motor.

18. The method of claim 16, further comprising automatically performing an autocorrect operation in response to the detected vibrations indicating that paper is not being fed from the input bin to the shredding mechanism.

19. The method of claim 16, wherein:

the auto-feed mechanism comprises a rolling drum and vacuum mechanism that are configured to automatically and repeatedly feed paper from the input bin to the shredding mechanism, and the method further comprises automatically running the rolling drum in reverse in response to the detected vibrations indicating that paper is not being fed from the input bin to the shredding mechanism.

20. The method of claim 16, further comprising automatically running the auto-feed mechanism in reverse in response to the detected vibrations falling below a predetermined threshold.

* * * * *